US006152085A

United States Patent [19]

Dethier et al.

[11] Patent Number: 6,152,085

[45] Date of Patent: Nov. 28, 2000

[54] METHOD FOR OPERATING A BOILER WITH FORCED CIRCULATION AND BOILER FOR ITS IMPLEMENTATION

[75] Inventors: Alfred Dethier, Lince; Pierre Grandjean, Siant-Sevrain, both of Belgium

[73] Assignee: Cockerill Mechanical Industries S.A., Seraing, Belgium

[21] Appl. No.: 09/147,753

[22] PCT Filed: Sep. 1, 1997

[86] PCT No.: PCT/BE97/00098

§ 371 Date: Jun. 17, 1999

§ 102(e) Date: Jun. 17, 1999

[87] PCT Pub. No.: WO98/10222

PCT Pub. Date: Mar. 12, 1998

[30] Foreign Application Priority Data

Sep. 2, 1996 [BE] Belgium ..... 9600735

[51] Int. Cl.[7] ..... F22D 7/00

[52] U.S. Cl. ..... 122/235.29; 122/406.5; 122/468; 60/653

[58] Field of Search ..... 122/235.29, 406.5, 122/466, 468, 442; 60/650, 653

[56] References Cited

U.S. PATENT DOCUMENTS

| | | | |
|---|---|---|---|
| 2,124,254 | 7/1938 | Ledinegg | 122/442 |
| 2,170,790 | 8/1939 | Zwilling | 122/235.29 |
| 3,135,096 | 6/1964 | Scroedter | 60/106 |
| 3,292,372 | 12/1966 | Michel | 60/73 |
| 4,080,789 | 3/1978 | Frei | 122/406.5 |
| 4,262,636 | 4/1981 | Augsburger | 122/406.5 |
| 4,520,762 | 6/1985 | Martin | 122/406.5 |
| 4,869,210 | 9/1989 | Wittchow | 122/406.5 |
| 5,762,031 | 6/1998 | Gurevich | 122/7 R |

FOREIGN PATENT DOCUMENTS 4303613 8/1994 Germany .

OTHER PUBLICATIONS

Patent Abstracts of Japan, vol. 15, No. 505 (M–1194), Dec. 20, 1991.

*Primary Examiner*—Denise L. Ferensic
*Assistant Examiner*—Gregory A. Wilson
*Attorney, Agent, or Firm*—Jacobson, Price, Holman & Stern, PLLC

[57] ABSTRACT

The invention concerns a boiler comprising at least a first heat exchanger (10) with its inlet connected to a water supplying duct (18) and its outlet connected, through a first regulating valve (30) to a steam turbine, either directly, or through a second heat exchanger (12). During the starting phase the regulating valve (30) is closed and as long as the fluid at the first heat exchanger (10) outlet is a mixture of water and steam, all the water is transformed into steam by condensation and the regulating valve (30) is opened only when the fluid at the first evaporator outlet is pure steam.

9 Claims, 1 Drawing Sheet

Figure 1:
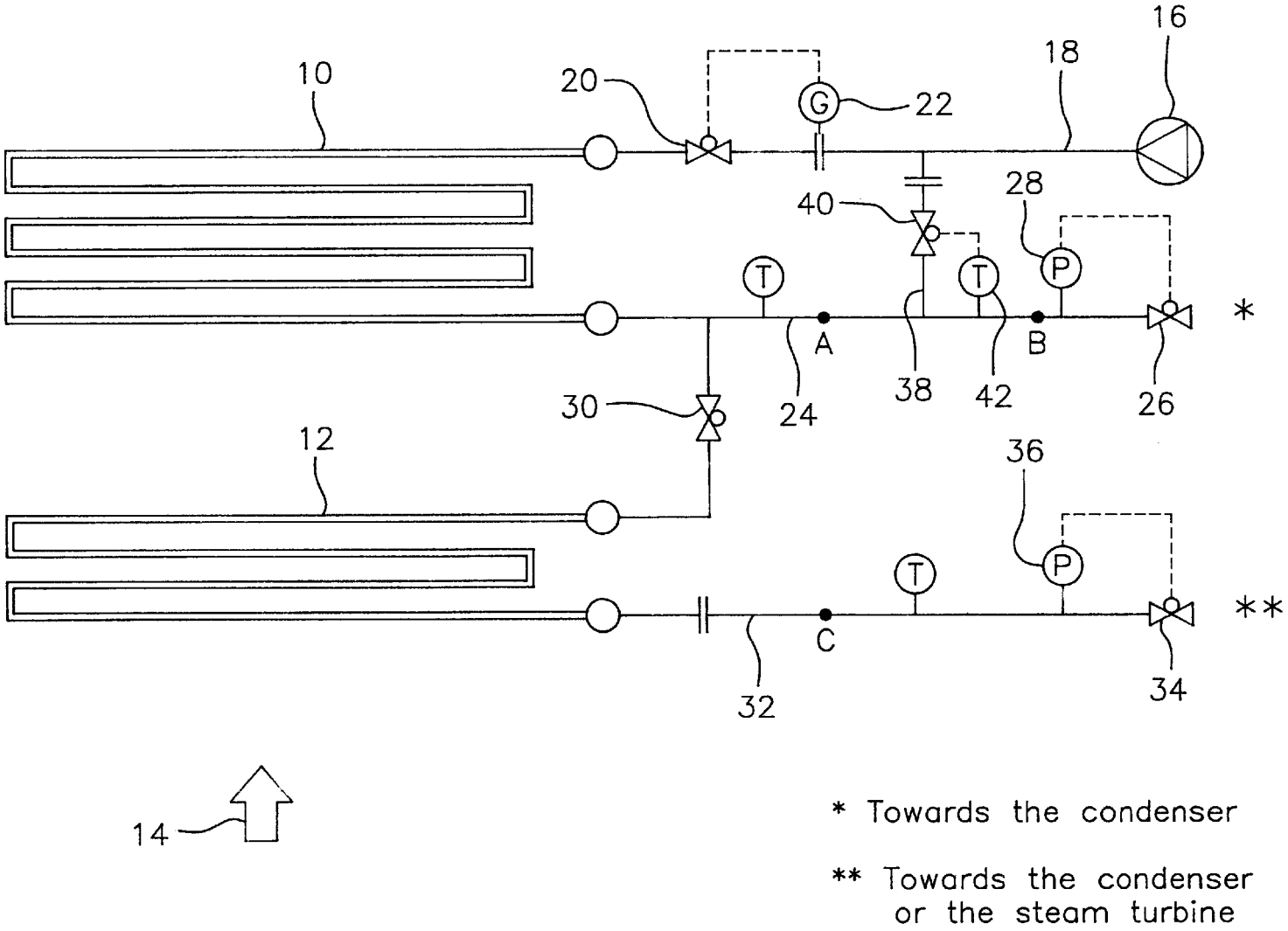

METHOD FOR OPERATING A BOILER WITH FORCED CIRCULATION AND BOILER FOR ITS IMPLEMENTATION

The present invention relates to a method of operating a forced-circulation boiler, especially for a steam turbine, said boiler comprising at least a first heat exchanger, the inlet of which is connected to a water feed line and the outlet of which is connected, via a regulated valve, either to the inlet of a second heat exchanger, the outlet of which is connected to the steam turbine, or directly to the steam turbine. The invention also relates to a boiler for implementing this method.

The invention is aimed more particularly, without being limited thereby, at boilers supplying steam turbines used in thermal power stations for generating electricity. This is because such power stations include a boiler producing pressurized steam which actuates a steam turbine which drives an electricity generator.

The boiler may be heated by a burner which burns fossil fuel or a fuel coming from industry. The boiler may also be a waste-heat boiler used in a so-called combined-cycle thermal power station. In this type of power station, a fuel, for example natural gas or fuel oil, is burnt in a gas turbine which drives an electricity generator. The exhaust gases from this gas turbine, in large volume and rich in thermal energy, are recovered in a so-called waste-heat boiler in order to produce pressurized steam which, via a steam turbine drives an electricity generator.

The pressurized steam produced in the boiler, instead of actuating a turbine, may optionally be used for other purposes.

These boilers always include heat exchangers operating as an evaporator (in the case of water) or as a superheater (in the case of steam), these being placed horizontally or vertically in a stream of hot gases. Several types of boilers may be distinguished depending on their type of heating, their arrangement, their operating principle, etc.

In a so-called natural-circulation boiler, the water is gradually converted into steam in an evaporator where the water and the water/steam mixture circulate by the difference in density, one with respect to the other. The evaporator is followed by a superheater in which the steam produced in the evaporator is heated to the desired temperature. Given that the operating principle is based on the difference in density between water and steam at a given temperature and a given pressure, these boilers cannot operate when this difference becomes too small, i.e. when the pressure increased. This operating principle can only operate at pressures below 150 to 160 bar.

Assisted-circulation boilers also include several exchangers, but here the water and the steam flow through the evaporator due to the effect of an external force, for example that of a pump. Assisted-circulation boilers may operate at higher pressures than natural-circulation boilers but when the pressure comes too close to the critical pressure, which is a 221.2 bar, it is no longer possible to separate the water and steam effectively, in order to allow normal operation of the plant, so that the principle of assisted circulation is limited to pressures less than approximately 180 bar.

It should in fact be recalled that both natural-circulation and assisted-circulation boilers include, between the evaporator and the superheater, a separator or drum necessary for separating the steam from the water, since the superheater and, above all, the turbine operate only using steam. In this separator, the water is separated by gravity from the steam and sent to the evaporator where it therefore makes several passes.

Although both these types of boilers are limited from the pressure standpoint, it is, on the other hand, well known that the efficiency of a steam turbine is better the higher the steam pressure. This is why most conventional thermal power stations use a so-called forced-circulation boiler, more often termed a "once-through boiler" which, in fact, better describes this type of boiler given that the water is heated in it, converted into steam and finally superheated during one pass through the boiler. In this case, there is no longer any precise distinction between the various types of exchangers. This boiler may include only a single exchanger, water entering on one side and superheated steam leaving on the other side, without any internal recirculation.

The current tendency of combined-cycle power stations is to increase the power of the gas turbines, to increase the temperature of the flue gases and to switch to operating the waste-heat boiler in forced-circulation mode. It is then possible to produce steam at very high pressure, including at the supercritical pressure.

Although these forced-circulation boilers, when running under steady operating conditions, could dispense with the separator, they cannot dispense with it during the startup phase since this phase always requires separation of the water from the steam given that the regulating devices, such as the pressure regulators, cannot operate using a two-phase fluid consisting of a mixture of steam and water.

During this startup phase, water passes through the first part of the exchanger, as far as the separator where the water and steam are separated by gravity. The water is drained from the separator to a condenser or other reservoir, while the steam passes through the second part of the exchanger before being superheated. During this startup phase, the separator is said to be operating wet.

As the temperatures and pressures rise, the separator receives less and less water and after the startup phase it then receives only steam and becomes superheated steam leaving on the other side, without any internal recirculation.

The current tendency of combined-cycle power stations is to increase the power of the gas turbines, to increase the temperature of the flue gases and to switch to operating the waste-heat boiler in forced-circulation mode. It is then possible to produce steam at very high pressure, including at the supercritical pressure.

Document DE 4,303,613 A1 describes a forced-circulation boiler comprising a steam/liquid water separator which, during startup and during normal operation of the boiler, separates the steam from the two-phase fluid leaving the evaporator in order to drain off the vapor as steam via a supercharger to the turbine.

The particular feature of this embodiment consists in using a steam/liquid separator, even when the boiler is running under steady operating conditions, although the boiler may also operate in low regime, i.e. in an assisted-circulation regime.

Document JP-02016119 describes a "once through" forced-circulation boiler which comprises the use of a separating tank for separating the vapor phase from the liquid-water phase of the two-phase mixture leaving the evaporator of the boiler during startup of the plant. Depending on the pressure reached by the steam, the latter is either recondensed or drained off to the turbine.

Document U.S. Pat. No. 3,292,372 describes a forced-circulation boiler in which the vapor phase is separated from the liquid phase (water) by means of a separating unit which is placed at the inlet of the boiler of the boiler [sic]. The liquid phase is recirculated directly or indirectly to the inlet of the boiler, while the vapor phase is drained off to a superheater.

Finally, document U.S. Pat. No. 3,135,096 describes a "once through" forced-circulation boiler which comprises two steam/liquid separators where the water and the steam are separated by gravity. A first separator (not illustrated) is placed after the evaporator in order to recirculate the unvaporized water via a mixer to the inlet of the evaporator and to drain off the other fraction of the fluid to the superheater of the boiler.

The second water-vapor/liquid separator is mounted as a bypass with respect to the turbines of the plant and, in principle, is used only during startup of the plant. This separator separates the liquid phase (water) from the vapor phase of the two-phase fluid leaving the superheater.

The liquid phase (water) is drained off to a condenser and the vapor phase is drained off by means of three pressure regulators and controllers either to a deaerator or via a heat exchanger to this deaerator or else to a condenser before returning to the inlet of the economizer of the boiler.

Although these forced-circulation boilers, when running under steady operating conditions, could dispense with the separator, they cannot dispense with it during the startup phase since this phase always requires separation of the water from the steam given that the regulating devices, such as the pressure regulators, cannot operate using an ascending stream of hot gases, shown symbolically by the arrow 14, these gases consisting of the exhaust gases from a gas turbine.

The evaporator is fed with water by a pump 16 via a feed line 18. The flow rate in the line 18 is regulated by a flow rate regulating valve 20 controlled by a flowmeter 22.

The outlet of the evaporator 10 is connected to a condenser (not shown) via an output line 24 and an expansion valve 26 controlled by a pressure gage 28. This expansion valve 26 controls and regulates the pressure in the evaporator circuit.

The outlet of the evaporator 10 is also connected via a regulating valve 30 to the inlet of the superheater 12. The outlet of the latter is connected via an output line 32 to the condenser and to the steam turbine (the latter not being shown). The pressure in the circuit for the superheater 12 is controlled by an expansion valve 34, under the control of a pressure gage 36 during the startup phase, and by the steam turbine in steady-state operation.

One of the features which characterizes the circuit of the boiler according to the present invention is a bypass line 38 between the inlet line 18 and the outlet line 24 of the evaporator, which line 38 allows a controlled amount of "cold" water to be mixed with the two-phase mixture produced by the evaporator during the startup phase of the boiler. The water flow rate in the line 38 is regulated by a regulating valve 40 controlled by a thermometer 42 which measures the temperature downstream of the line 38.

The operation of the boiler shown schematically in the FIGURE will now be described.

Before the gas turbine is started up, the evaporator is pressurized to a pressure compatible with the temperature of the turbine gases. This pressure, which is controlled by the expansion valve 26, may be below the rated pressure (for example 100 bar). A minimum flow rate (for example 30%) is provided by the pump 16 and regulated by the valve 20, with a return to the condenser via the expansion valve 26. The regulating valve 30 is, at this moment, closed and the superheater 12 is isolated from the circuit for the evaporator 10.

The gas turbine is then started up and stabilized to a capacity such that the temperature of the exhaust gases is approximately 100° C. above the saturation temperature in the evaporator 10, i.e. approximately 400° C. in the case of the pressure chosen.

The temperature of the water leaving the evaporator 10 at the point A rapidly increases up to the saturation temperature and then stabilized to the evaporation plateau. When this temperature is almost reached at the point B, the thermometer 42 causes the valve 40 to be gradually opened in order to allow a controlled amount of "cold" water to flow into the line 24 so that the temperature is below the saturation temperature (for example 300° C.). Thus, the steam which starts to form in the evaporator 10 above the saturation temperature is converted into water because of this influx of "cold" water, with the result that the expansion valve 26 always remains with water at its inlet (with a water/steam mixture, it could not operate) and retains its ability to regulate.

As the evaporation progresses, the proportion of steam increases to the detriment of the proportion of water at the outlet of the evaporator 10. Consequently, the valve 40, controlled by the thermometer 42, opens further in order to supply the quantity of water necessary for condensing all the steam and so that the temperature at B is maintained below the saturation temperature. This scenario lasts until there is no longer any water leaving the evaporator. From that moment, the temperature rises again due to the superheating of the steam. The absence of water at the outlet of the evaporator is therefore easily detectable by an increase in the temperature at A. This detection is used to gradually open the valve 30 in order to divert the steam 30 [sic] to the superheater 12 and to gradually close the valve 40 and the expansion valve 26.

The steam is now superheated to the desired temperature in the exchanger 12, the pressure in which is controlled by the expansion valve 34. When the regulating valve 30 is fully open, or optionally short-circuited by a bypass, the entire output passes through both exchangers, thereby completing the startup phase and commencing steady-state operation.

Thereafter, the capacity of the gas turbine may be increased. The water flow rate will be regulated by the steam temperatures at the outlets of the evaporator 10 and of the superheater 12, and the expansion valve 34 increases the pressure to the rated value.

In steady-state operation, the temperature of the steam leaving the evaporator remains slightly superheated, by about 50° C.

The final temperature of the steam leaving the boiler will be as required for the rated speed, or it may be controlled by an optional additional desuperheater for partial loads or peak loads.

The operation described above applies in the case of a supercritical or non-supercritical rated operating pressure. It may also be used in the case of relatively low pressures.

If the heating temperature is particularly low, the system for converting the steam into water during startup may be transposed to the output side of the boiler which, consequently, would then have only a single exchanger.

What is claimed is:

1. Method of operating a forced-circulation boiler for a steam turbine, the boiler comprising at least a first heat exchanger, an inlet of which is connected to a water feed line and the outlet of which is connected, via a regulating valve, either to an inlet of a second heat exchanger, an outlet of which is connected to the steam turbine, or directly to the steam turbine, said method comprising: closing the regulating valve during a startup phase, in that, for as long as the fluid leaving the first exchanger is a two-phase fluid consisting of a mixture of water and steam, this two-phase fluid is converted, by condensation, into liquid water without prior separation of the gas and liquid phases of the two-phase fluid and in that, when the fluid leaving the first evaporator is pure steam, the regulating valve is gradually open.

2. Method according to claim 1, wherein the condensing operation at the outlet of the first evaporator is caused by mixing the two-phase fluid with feedwater.

3. Method according to claim 2, wherein the quantity of feedwater necessary for condensing the two-phase fluid is regulated with respect to the temperature of the fluid downstream of the point where the output line joins the bypass line, so that, during the startup phase, this temperature remains below the saturation temperature remains below the saturation temperature.

4. Method according to claim 1, wherein the condensation water is recycled to the inlet of the first heat exchanger, via a condenser and a pump.

5. Forced-circulation boiler for a steam turbine, comprising at least a first heat exchanger, an inlet of which is connected to a water feed line and an outlet of which is connected, via a first regulating valve, to a steam turbine, either directly or via a second heat exchanger, the outlet of the first exchanger being connected to the water feed line by a bypass line between the inlet line and the outlet line of the first exchanger, comprising a second regulating valve for mixing a controlled amount of "cold" water with the two-phase fluid produced by the first exchanger during a startup phase.

6. Forced-circulation boiler according to claim 5, wherein the second heat exchanger is isolated from the circuit of the first heat exchanger during the startup phase until the fluid leaving the first evaporator is pure steam.

7. Forced-circulation boiler according to claim 5, wherein the second regulating valve is regulated with respect to the temperature in the line downstream of the point where the outlet line joins the bypass line, so that, during the startup phase, this temperature remains below the saturation temperature.

8. Forced-circulation boiler according to claim 5, wherein the outlet of the first exchanger is connected to an expansion valve located downstream of the point where the outlet line joins the bypass line to control the pressure inside the first heat exchanger.

9. Forced-circulation boiler according to claim 5, wherein a condenser is placed downstream of said expansion valve and in that a pump causes the condensed water to recirculate into the inlet of the first heat exchanger.

* * * * *